US005341792A

United States Patent [19]

Pucillo

[11] Patent Number: 5,341,792

[45] Date of Patent: Aug. 30, 1994

[54] ARCHERY BOW AND APPURTENANCE

[76] Inventor: Anthony D. Pucillo, 2210 Bermondsey Dr., Mitchelville, Md. 20721

[21] Appl. No.: 3,421

[22] Filed: Jan. 12, 1993

[51] Int. Cl.[5] ..... F41B 5/00

[52] U.S. Cl. ..... 124/89; 124/23.1; 124/25.6

[58] Field of Search ..... 124/87, 88, 89, 44.5, 124/41.1, 23.1, 25.6; 248/218.4, 225.31, 225.2, 227, 339

[56] References Cited

U.S. PATENT DOCUMENTS 3,286,961 11/1966 Mandolare .
3,412,725 11/1968 Hoyt ..... 124/89
3,468,508 9/1969 Huver .
3,658,157 4/1972 Lee ..... 124/89
3,861,633 1/1975 Rappleye et al. .
3,991,780 11/1976 Maroski ..... 124/23.1
4,628,893 12/1986 Shaw, III ..... 124/23.1

*Primary Examiner*—Randolph A. Reese
*Assistant Examiner*—Anthony Knight
*Attorney, Agent, or Firm*—Morris Kaplan

[57] ABSTRACT

In an archery bow, mechanically coupled means that transversely overlay and clamp onto opposed faces at an outer section of a bow limb onto opposed faces at an outer section of a bow limb to inhibit vibration, twisting and splitting of such limbs and a hook element extending from an outer one of the means for supporting the bow by suspension.

1 Claim, 1 Drawing Sheet

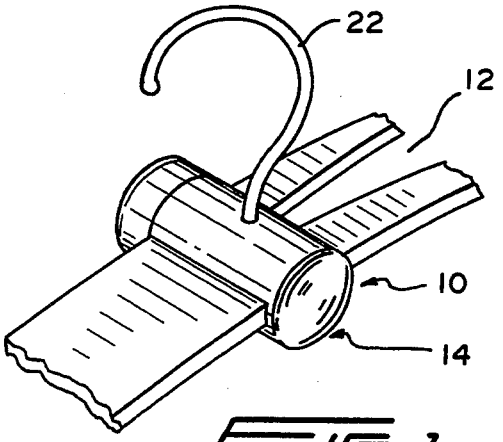
FIG. 1
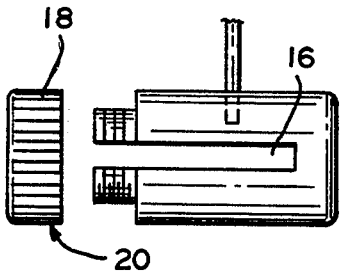
FIG. 2
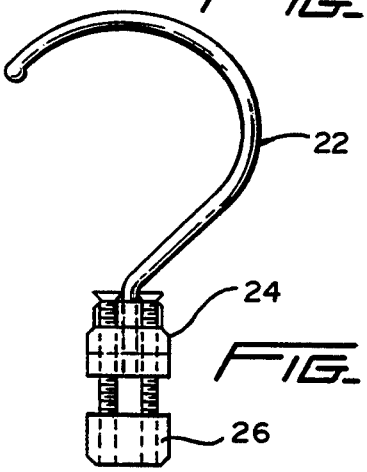
FIG. 4
FIG. 3
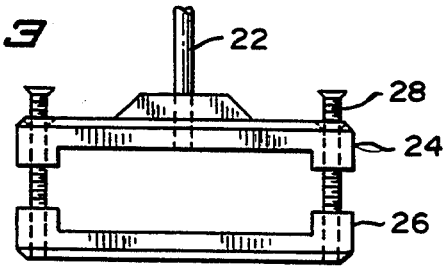
FIG. 5
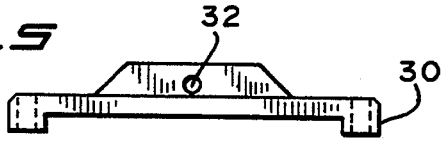
FIG. 7
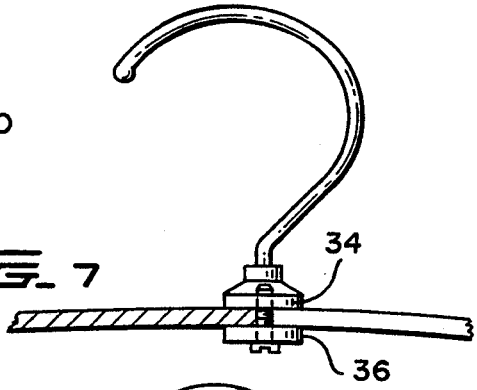
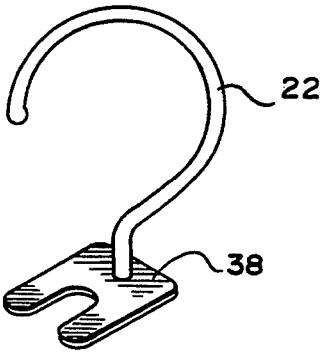
FIG. 8
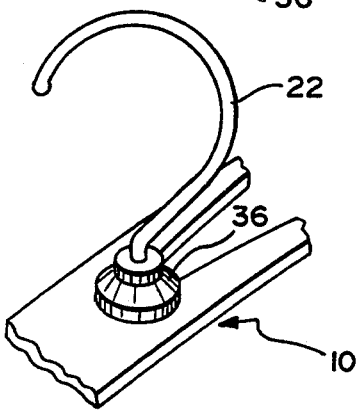
FIG. 6

ARCHERY BOW AND APPURTENANCE

TECHNICAL FIELD

The present invention relates to an improved archery bow structure and a support appurtenance therewith.

BACKGROUND OF THE INVENTION

It is known that the drawing and releasing of a bow string produces vibration in the bow arms and, in the compound bow, at the crotch areas, additionally produces unequal distribution of transverse stresses which initiate transverse twisting and longitudinal splitting.

The prior art treats the vibration problem by a disposition of weights, e.g., U.S. Pat. Nos. 3,196,860 to Hoyt, Jr. and 3,525,322 to Lee, which disclose mounting simple weights on an archery bow, and French 2,520,494 to Pugnaire, application published July 1983, which discloses a pair of plates to be mounted on a bow and wherein one plate supports a pair of spindles that each extend through a coil spring while a second plate is mounted on said spindles and is influenced by the springs.

To contend with the problems of transverse twisting and longitudinal twisting in a compound bow, U.S. Pat. No. 4,350,138 to Caldwell discloses extending the handle to meet each arm element at an intermediate section thereof and attach thereto by a pivotal member that is clamped onto its associated arm element near to or adjacent the inner termination of the arm crotch, the inner arm end being tethered to the handle. U.S. Pat. No. 3,965,883 to Meyer introduces bow twist resistance by thickening sections of the bow limbs and adding elevated string guides.

A further problem, but ancillary to archery bow use rather than to basic structure, is the support thereof in the field. It is not desirable to support the bow either on the ground or depending from a crook formed by its basic structure.

SUMMARY OF THE INVENTION

The present invention is directed to a novel and improved bow structure and is especially adaptable to a compound bow wherein, at the crotch area of the arm, means inhibit both the unequal distribution of transverse force at the crotch area and longitudinal splitting of the arm and wherein such means are independent of the bow's handle or handle riser structure.

It is an object of the invention that such means overlie and clamp the inner terminating portion of the crotch.

It is a further object of the invention that such means clamp and transversely encompass the arm portion inclusive of the inner terminating portion of the crotch.

It is an additional object of the invention that such means which inhibit unequal distribution of transverse forces and longitudinal splitting be compounded in structure with simple hook means whereby to support or hang the bow.

It is another object of the invention that the device be adapted to either of a simple or a compound bow and additionally function to dampen vibration and to inhibit undesired rotational and translational movements.

It is yet another object of the invention that the device be simple and inexpensive to manufacture and install.

For a more fully developed presentation of the invention and preferred embodiments thereof, reference is made to the following descriptive matter, appended claims, and attached drawings.

BRIEF DESCRIPTION OF THE DRAWINGS

FIG. 1 is a perspective view of a first embodiment of the invention;

FIG. 2 is a partial exploded view of FIG. 1;

FIG. 3 is a front view of modified clamp and hanger means;

FIG. 4 is a side elevation view of FIG. 3 but illustrating the hanger means in full;

FIG. 5 is a front view of a modification of the upper clamp element of FIG. 3;

FIG. 6 is a perspective view of a grommet-type clamp and hanger means;

FIG. 7 is an elevational view, partly in section, of FIG. 6 taken along the longitudinal axis thereof; and FIG. 8 is a perspective view of a modified hanger portion.

DETAILED DESCRIPTION

For purposes of clarity, the drawings are not drawn to scale but are clear and certain when taken with the following descriptive matter.

Referring to the drawings which disclose preferred embodiments of the invention and wherein like numerals indicate like elements of structure, FIG. 1 discloses, in an otherwise conventional compound bow, an outer limb section 10 having the expected forked structure defining crotch 12. The limb at its outboard end (not shown) supports a pulley and cable therewith, as is known in the art.

Mounted on limb 10 is a slotted member 14 (FIGS. 1 and 2) that receives an entire transverse section of the limb in a close sliding fit in slot 16. The member is threaded 18 at its open end and securely clamped to the limb by nut 20. The secured member in clamped disposition on the limb overlies the inner terminal section of the fork and crotch 12 on each face of the limb and a small section of the limb that is longitudinally inward of the crotch terminus and transversely encompasses the limb inclusive of such overlaid areas.

Extending outwardly of about the mass center of the member, from the member portion disposed on the outer limb face, is a hook element 22 that is made integral with the member and adapts the member to be suspended from a support, as, for instance, from a tree limb.

The limb structure, inclusive of the member clamped and disposed as aforedescribed, whether compounded with the hook element or not, now adapts the bow structure to have a more uniform distribution of stress at the crotch area to move more uniformly as a structural unit and to be less apt to chatter, twist about the bow's longitudinal axis, or split along said axis.

Though shown to be a substantially unitary device and to be rounded in cross-section, the member 14 may be otherwise configured according to design and mechanical expediencies and may comprise separate elongated parts, as shown in FIGS. 3 and 4, by plates 24, 26, adapted to be secured by threaded means 28.

FIG. 6 illustrates that a hook element, which may in any case be formed integral with the clamp member or threaded thereto, may also be attached to an upper clamp member plate 30 at a transversely extending hole 32 therein.

Grommet-type clamp means may be utilized to enhance bow structure for all beneficial purposes as aforedescribed, as illustrated in FIGS. 6 and 7 by elements 34, 36, but such grommet-type clamp means does not function as well as the encompassing types illustrates in FIGS. 1–5. The grommet parts may be threadedly coupled.

Instead of the hook being made integral with the grommet-type clamp element, as shown, for instance, in FIGS. 6 and 7, the hook may be made integral with a slotted plate 38 (FIG. 8), which latter is adapted to be disposed beneath an upper element of a grommet-type clamp.

The embodiments shown and described are only illustrative of the present invention and are not to be construed as delimitive thereof since, once apprised of the invention, changes in structure would be readily apparent to one skilled in the art.

Hence, the present invention includes all modifications of structure encompassed within the spirit and scope of the following claims.

I claim:

1. A compound archery bow having, at a longitudinally outer limb section, a conventional crotch configuration that is the inner terminus of a pulley supporting fork structure, means to effect uniform distribution of stresses and to inhibit longitudinal splitting, vibrations and twisting about the longitudinal and transverse axes of the limb and said means to effect and inhibit being structurally compounded for appurtenance purposes, said means comprising:

an open-ended slotted bar that is threaded at its open end and operatively associates with the limb in a close sliding fit transverse to the limb's axis, the bar overlying in part exactly the inner terminus of said crotch and being retained on said limb by a threaded nut, and a hook element extending from said bar, whereby the bow is adapted to be supported by suspension.

* * * * *